US008935834B2

(12) United States Patent
Mouche et al.

(10) Patent No.: US 8,935,834 B2
(45) Date of Patent: Jan. 20, 2015

(54) TRIPLE UNFOLDING CLASP

(75) Inventors: Laurent Mouche, L'Orient (CH); Tommaso Biraghi, Sesto Calende (VA) (IT); Stéphane Cadau, Le Sentier (CH); Cédric Meiller, Charnas (FR)

(73) Assignee: Montres Breguet SA, L'Abbaye (CH)

( * ) Notice: Subject to any disclaimer, the term of this patent is extended or adjusted under 35 U.S.C. 154(b) by 295 days.

(21) Appl. No.: 13/523,499

(22) Filed: Jun. 14, 2012

(65) Prior Publication Data

US 2012/0318018 A1 Dec. 20, 2012

(30) Foreign Application Priority Data

Jun. 16, 2011 (EP) ..... 11170091

(51) Int. Cl.
*A44C 5/24* (2006.01)

(52) U.S. Cl.
CPC ..... *A44C 5/24* (2013.01)
USPC ..... 24/265 WS; 24/71 J; 224/164

(58) Field of Classification Search
CPC ..... A44C 5/24
USPC ..... 24/265 WS, 71 J, 68 J; 224/164; 368/282
See application file for complete search history.

(56) References Cited

U.S. PATENT DOCUMENTS

| | | | | |
|---|---|---|---|---|
| 5,313,691 | A * | 5/1994 | Hashimoto | 24/265 WS |
| 6,434,798 | B1 * | 8/2002 | Yamakawa et al. | 24/265 WS |
| 6,944,916 | B2 * | 9/2005 | Kawagoe | 24/265 WS |
| 2007/0271740 | A1 * | 11/2007 | Yamamoto | 24/265 WS |

FOREIGN PATENT DOCUMENTS

| | | | | |
|---|---|---|---|---|
| CH | 665101 | A5 * | 4/1988 | A44C 5/24 |
| EP | 0 567 246 | A1 | 10/1993 | |
| EP | 0714616 | B1 * | 8/2000 | A44C 5/24 |
| FR | 627 448 | A | 10/1927 | |
| JP | 09-000320 | A | 1/1997 | |
| JP | 2596491 | Y2 * | 6/1999 | A44C 5/24 |

* cited by examiner

*Primary Examiner* — Robert J Sandy
(74) *Attorney, Agent, or Firm* — Sughrue Mion, PLLC

(57) ABSTRACT

Bracelet clasp (1) with a buckle (10) having strands carrying shouldered pins (6, 7) cooperating with eyes (8, 9) in the buckle, with two pushers (11, 12) antagonistic against springs, each controlling two bolts (15, 16; 17, 18), where the first pusher (11) integrally drives a first bolt (15) opposite a first pin (6) and a second bolt (16) opposite a second pin (7), this first pin (6) and a second bolt (18) opposite this second pin (7), so that only the combined actuation of the two pushers (11, 12) drives all of the bolts (15, 16, 17, 18) through their entire release travel to release these pins (6, 7) and one of the bolts (17, 18) remains locked during insertion of a pin (6, 7) in an eye (8, 9).

14 Claims, 3 Drawing Sheets

Fig. 9
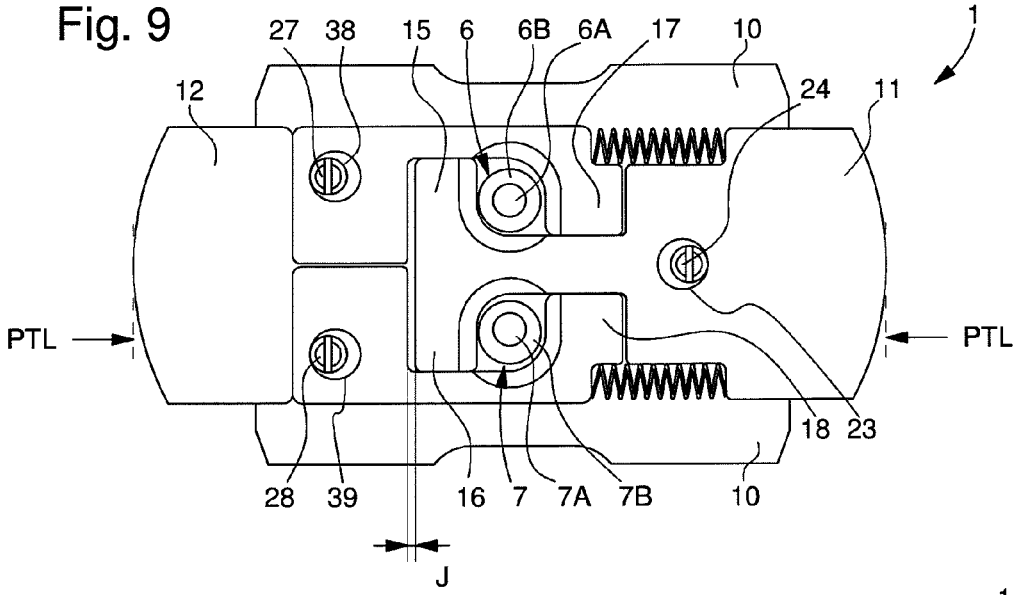
Fig. 10
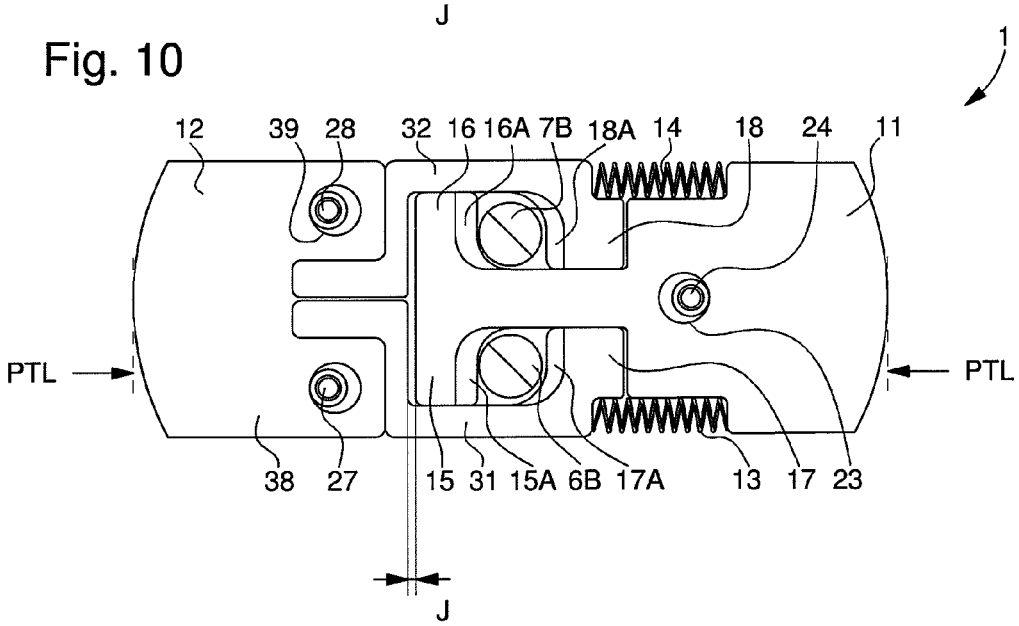
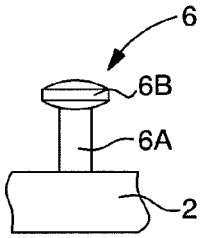
Fig. 4
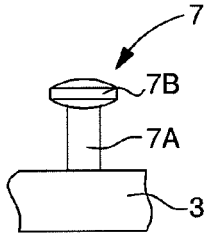
Fig. 5

TRIPLE UNFOLDING CLASP

This application claims priority from European Patent Application No. 11170091.0 filed Jun. 16, 2011, the entire disclosure of which is incorporated herein by reference.

FIELD OF THE INVENTION

The invention concerns a triple security unfolding clasp for holding both ends of a bracelet or strap, said clasp including a buckle around both sides of which are hinged a first strand and a second strand, each carrying a shouldered locking pin or eye respectively and arranged to cooperate in a closing position of said clasp with a complementary locking eye or pin respectively comprised in said buckle, and said buckle comprising a first pusher and a second pusher which can move in the same direction, each against resilient return means returning said pushers to a locking position and each arranged to control, directly or indirectly, the forward or backward movement of two bolts, which are antagonistic in said direction to opposite bolts controlled by the other of said pushers, each said bolt being arranged to immobilise, in said closing position, at said complementary locking eye or pin respectively, a constricted portion comprised in said locking pin or eye respectively, and the individual travel of each of said pushers being smaller than a release travel during which at least two antagonistic bolts release, in an opening position, said constricted portion of at least one of said locking eyes or pins respectively, and the combined travel of said pushers being greater than or equal to said release travel.

The invention also concerns a bracelet or wristband including a clasp of this type.

The invention concerns the field of securing objects, in particular to the person, and concerns more specifically the fields of horology, and jewellery.

The invention will be described more specifically for the field of horology-jewellery, for fastening bracelets, wristbands or wristwatches.

BACKGROUND OF THE INVENTION

Numerous clasps are known for bracelets, in particular for wristwatches or for jewellery, which comprise unfolding moveable strands.

In many clasps, called triple clasps, i.e. including two strands hinged to a buckle on which they are folded down, each strand including a pin cooperating in a locking position with one eye of the buckle, the buckle is fitted with two resiliently mounted pushers. Often, pressure on only one of the two pushers can cause the clasp to open, which is unsatisfactory from a safety viewpoint. Likewise, after a first strand has been locked, it is common for the closing of the other strand to have the effect, by separating the pushers, of releasing the strand which was already locked and which was providing provisional security. Certain designers have overcome this latter defect by setting a sequential closing order of the strands, which is inconvenient for the user.

Various clasp devices propose solutions to this problem. Thus CH Patent No. 670 941 in the name of CORNU & CIE SA discloses a clasp with a small number of components, which utilises the elastic deformation of pusher branches in the shape of tuning forks, the ends of which form retaining stops for the strands. EP Patent No. 0 549 846 in the name of GTF SRL discloses a bolt device comprising bolts, having concave paths on which a V-shaped spring abuts, which project outside a case to cooperate with hooks comprised in the strands, and for unlocking, a single pusher pushes ramps comprised in these bolts, against the spring which works by buckling. JP Patent No. 9000320 in the name of CITIZEN discloses a clasp with four bolts each provided with a ramp-shaped cam, arranged in pairs opposite springs and operated against these springs by two pushers each comprising two antagonistic ramps.

CN Patent No. 201278878Y in the name of HUADONG GUAN presents a clasp with two pushers pushed back by a first spring, each carrying two claws pushed outwards by a spring perpendicular to the first spring.

In short, the solutions proposed are often complex or fragile, since they are essentially based on the elasticity of certain components.

SUMMARY OF THE INVENTION

The invention proposes to make a safety clasp, which guards against untimely opening, or against reopening, when, for example, after one strand of the clasp has already been folded down and a first pin locked onto the buckle, the closing of the second strand and insertion of the pin carried thereby causes the first pin to unlock and the clasp to reopen and even the watch or object connected to the bracelet to fall.

Therefore, the invention concerns a triple security unfolding clasp for holding two ends of a bracelet or strap, said clasp comprising a buckle around either side of which are hinged a first strand and a second strand, each carrying a shouldered locking pin or eye respectively, and arranged to cooperate in a closing position of said clasp with a complementary locking eye or pin respectively comprised in said buckle, and wherein said buckle includes a first pusher and a second pusher which can move in the same direction, each against resilient return means returning said pushers towards a locking position and each arranged to control, directly or indirectly, the forward or backward movement of two bolts, which are antagonistic in said direction against opposite bolts controlled by the other of said pushers, each said bolt being arranged to immobilise, in said closing position, at said complementary locking eye or pin respectively, a constricted portion comprised in said locking pin or eye respectively, and the individual travel of each of said pushers is smaller than a release travel during which at least two antagonistic bolts release, in an opening position, said constricted portion of at least one of said locking pins or eyes respectively, and the cumulated travel of said pushers is greater than or equal to said release travel, characterized in that said first pusher simultaneously, directly and integrally drives a first primary bolt opposite a first locking pin or eye respectively, and a second primary bolt opposite a second locking pin or eye respectively, whereas said second pusher independently drives a first secondary bolt opposite said first locking pin or eye respectively, and a second secondary bolt opposite said second locking pin or eye respectively, so that only the combined actuation of said two pushers causes the movement of all of the bolts through their entire release travel to release both said first locking pin and said second locking pin or eyes respectively, and so that one of said two secondary bolts remains in the locking return position during the insertion of one of said locking pins or eyes respectively towards said complementary locking eye or pin respectively corresponding thereto, to take a locking position.

According to one feature of the invention, when the user presses, said second pusher is arranged to push, in said direction and via a bearing surface comprised in said second pusher, a first bearing surface of said first secondary bolt, and a second bearing surface of said second secondary bolt, so as to move said first secondary bolt and said second secondary bolt parallel to each other.

According to another feature of the invention, in the absence of any action by the user on one of the pushers, said first secondary bolt and said second secondary bolt can move independently of each other against resilient return means.

According to yet another feature of the invention, a first said complementary locking eye or pin respectively, is delimited by the cooperation of said first primary bolt and said first secondary bolt, and a second said complementary locking eye or pin respectively is delimited by the cooperation of said second primary bolt and said second secondary bolt, and each said complementary locking eye or pin respectively constitutes a chamber of variable volume, between an opening position in which it is able to let pass a head comprised in said locking pin or eye respectively corresponding thereto, and a closing position in which it is able to grip said constricted portion of one said locking pin or eye respectively corresponding thereto, between jaws formed by bearing surfaces comprised in said bolts concerned, and immobilising said head on the opposite side to said strand carrying said locking pin or eye respectively concerned, relative to said jaws.

The invention also concerns a bracelet or wristband including a clasp of this type.

BRIEF DESCRIPTION OF THE DRAWINGS

The invention will be become clearer upon reading the following detailed description, with reference to the annexed drawings, in which:

FIGS. 4 and 5 each show a side view of a construction detail of the two pins secured to their respective strands.

FIG. 9, similar to FIG. 7, shows a device preventing the clasp from opening.

FIG. 10 shows the bottom view of FIG. 9.

DETAILED DESCRIPTION OF PREFERRED EMBODIMENTS

The invention concerns the field of securing objects, in particular to the person, and concerns more specifically the fields of horology, and jewellery.

The invention will be described more specifically for the field of horology-jewellery, for fastening bracelets, wristbands or wristwatches.

The invention concerns a triple security unfolding clasp for holding two ends 200, 300 of a bracelet 100 or a strap. "Strap" is to be understood in the broad sense and may be a harness, a load retaining strap or other type of strap fastener.

This description more specifically concerns a clasp 1 for a wristwatch or bracelet 100, but this preferred application is in no way limiting.

Figure 1:
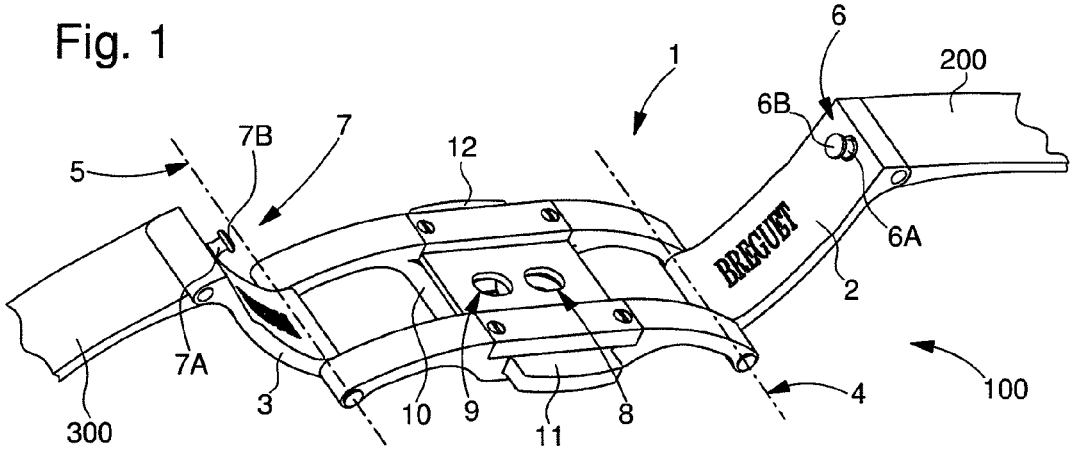
FIG. 1 shows a schematic, partial, perspective view of a bracelet provided with a clasp according to the invention, with two strands hinged on a buckle closing the mechanism controlled by two substantially coplanar pushers.

As seen in FIG. 1, this clasp 1 includes a buckle 10 on each side of which there are hinged articulating means 4 and 5, such as hinges or similar, for a first strand 2 and a second strand 3 which are in turn connected to the ends 200, 300 of bracelet 100, each carrying a locking pin 6, 7. The invention is illustrated with this configuration of projecting pins, but it is also applicable to a mirror opposite design where the pins are replaced by eyes, and the eyes are replaced by pins.

As seen in FIGS. 4 and 5, each locking pin 6, 7 or eye respectively is preferably shouldered, comprising a head 6B, 7B and a constricted portion 6 A, 7A of smaller diameter or dimensions than head 6B, 7B and is arranged to cooperate in a closing position of clasp 1 with a complementary locking eye 8, 9 or pin respectively comprised in buckle 10.

This buckle 10 includes a first pusher 11 and a second pusher 12 which can move in the same direction D, each against resilient return means 13, 14 returning said pushers to a locking position, and each arranged to control, directly or indirectly, the forward or backward movement of two bolts 15, 16 for the first pusher 11, two bolts 17, 18 for the second pusher 12, which are antagonistic in direction D to opposite bolts, respectively 17, 18 and 15, 16 controlled by the other pusher 12, 11. This direction D is shown in the Figures in a preferred embodiment in which, in a conventional manner, it is perpendicular to the direction of elongation of bracelet 100.

In a particular version illustrated in the Figures, the first pusher 11 and the second pusher 12 are substantially coplanar and preferably coplanar.

Each of these bolts 15, 16, 17, 18 is arranged to immobilise, in this closing position, at complementary locking eye 8, 9 or pin respectively, the constricted portion 6A, 7A of the locking pin 6, 7 or eye respectively concerned.

The individual travel of each of pushers 11, 12 is smaller than a release travel during which at least two antagonistic pins release, in an opening position, the constricted portion 6A, 7A of at least one of the locking pins 6, 7 or eyes respectively.

The combined travel of pushers 11, 12 is greater than or equal to this release travel.

Figure 2:
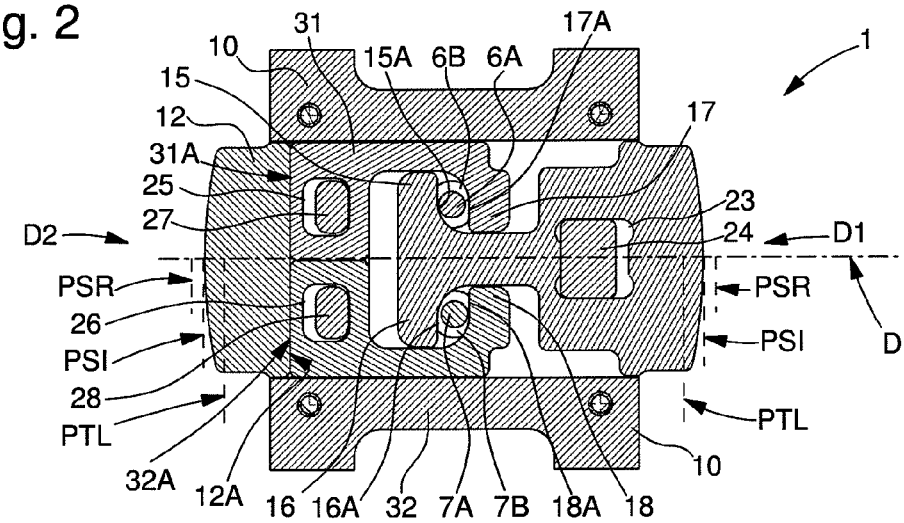
FIG. 2 shows a schematic, partial, top cross-section in a common and substantially median plane to said two pushers, of the central portion of the clasp according to the invention, in a stable locking position of two pins each connected to one of the two strands.

According to the invention, and as particularly seen in FIG. 2, the first pusher 11 directly, integrally and simultaneously drives a first primary bolt 15 opposite a first locking pin 6 or eye respectively, and a second primary bolt 16 opposite a second locking pin 7 or eye respectively. Preferably, the first pusher, the first primary bolt 15 and the second primary bolt 16 form a single piece assembly.

Whereas second pusher 12 drives, independently of each other, a first secondary bolt 17 opposite said first locking pin 6 or eye respectively, and a second secondary bolt 18 opposite said second locking pin 7 or eye respectively, so that only the combined actuation of these two pushers 11, 12 causes the movement of all of bolts 15, 16, 17, 18 through their entire release travel to release both first locking pin 6 and second locking pin 7 or eyes respectively, and so that one of the two secondary bolts 17, 18 remains in the locking return position during insertion of one of said locking pins 6, 7 or eyes respectively towards the complementary locking eye 8, 9 or pin respectively corresponding thereto, to take a locking position.

Figure 3:
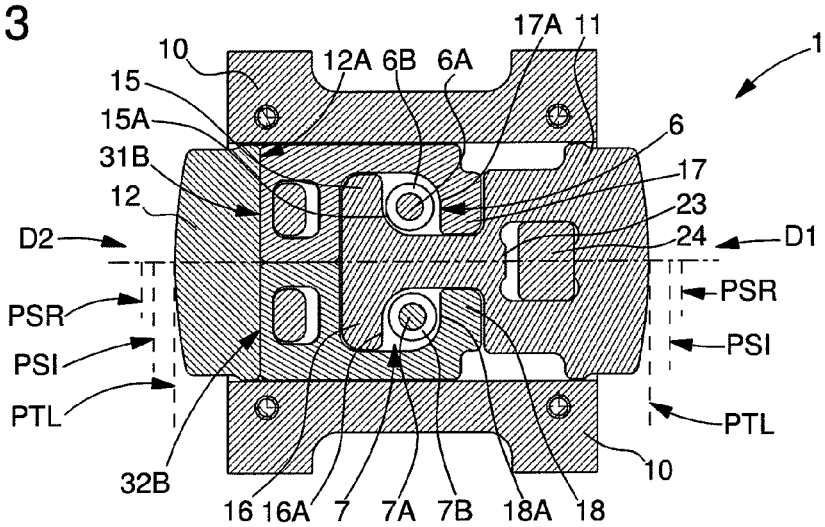
FIG. 3 shows, in a similar manner to FIG. 2, the same mechanism in a transitory position where the two pushers are completely pushed in and the two pins can be freely inserted or removed relative to the clasp.

Preferably, as seen in FIG. 3, when the user exerts pressure, the second pusher 12 is arranged to push in direction D, via a bearing surface 12A comprised in said second pusher 12, a first bearing surface 31B of the first secondary bolt 17 or a first female slide 31 carrying said first secondary bolt 17, and a second bearing surface 32B of the second secondary bolt 18, or a second female slide 32 carrying said second secondary bolt 18, so as to move said first secondary bolt 17 and said second secondary bolt 18 parallel to each other.

Preferably, according to the invention, in the absence of any action by the user on one of pushers 11, 12, the first secondary bolt 17 and the second secondary bolt 18 can move independently of each other against resilient return means. This arrangement is particularly advantageous, since it allows one of said two secondary bolts to be kept in the locking position. For example, it keeps an already engaged pin 6 or 7 locked, when the operator handles the strand carrying the other pin which is not yet engaged in the clasp, inserts the pin in the corresponding eye and consequently tends to move the bolts away from said eye to allow said other pin to pass, without, however, releasing the pin which is already engaged and locked. This also means that when, during insertion of the other pin, the first pusher moves away from the locking position, the secondary bolt which was holding the already engaged pin is not affected by this manoeuvre and remains in the locking position.

Advantageously, as seen in FIGS. 6 to 10, in the absence of any action by the user on one of pushers 11, 12, the first secondary bolt 17 and the second secondary bolt 18 can move independently of each other against resilient return means which are the same as the resilient return means 13, 14 against which the first pusher 11 and second pusher 12 can move.

It is clear that the complementary locking eyes 8, 9 or pins respectively are chambers of variable geometry, each delimited by a primary bolt actuated by the first pusher 11 and by a secondary bolt actuated by the second pusher, said primary and secondary bolts 12 being arranged to behave like jaws immobilising the corresponding locking pins 6, 7 or eyes respectively. Thus, a first complementary locking eye 8 or pin respectively is delimited by the cooperation of the first primary bolt 15 and the first secondary bolt 17 and a second complementary locking eye 8 or pin respectively is delimited by the cooperation of the second primary bolt 16 and the second secondary bolt 18. Each complementary locking eye 8, 9 or pin respectively forms a chamber of variable volume, between an opening position in which it is capable of allowing a head 6B, 7B to pass, respectively comprised in the corresponding locking pin 6, 7 or eye, and a closing position in which it is capable of gripping the constricted portion 6A, 7A of said locking pin 6, 7 or eye respectively corresponding thereto, between jaws formed by bearing surfaces comprised in said bolts concerned, while immobilising the head 6B, 7B on the opposite side to the strand 2, 3 carrying the locking pin 6, 7 or eye respectively concerned, relative to said jaws.

The first pusher 11, like the second pusher 12, can move in direction D between a first stable rest position PSR in which the extension thereof relative to buckle 10 is maximum, and in which it does not cooperate with any of locking pins 6, 7 or eyes respectively, another second intermediate stable locking position PSI in which it immobilises at least one of locking pins 6, 7 or eyes respectively, and a third transitory release position PTL when the user maintains pressure and in which the pusher tends to release locking pins 6, 7 or eyes respectively.

In a particular embodiment, the first stable rest position PSR and said second intermediate stable locking position PSI of first pusher 11 are the same. Likewise, the first stable rest position PSR and said second intermediate stable locking position PSI of the second pusher 12 are the same.

The first pusher 11 can move from its first stable rest position to its third transitory release position in a first actuating direction D1, and the second pusher 12 can move from its first stable rest position to its third transitory release position in a second actuating direction D2 opposite to first direction D1.

Only as regards the first pusher 11, this third transitory release position PTL may also be reached, not via action by the user on the pusher(s), but via action of the user on one of strands 2 or 3.

However, the particular kinematics belonging to the second pusher 12, which pushes secondary bolts 17 and 18 independently of each other, are irreversible. The complete return of one of the two secondary bolts 17 and 18 in direction D1 opposite to direction D2 has the effect of returning the second pusher 12 to its first stable rest position PSR if, at the secondary bolt concerned, the pin is not engaged with the corresponding eye, and the other secondary bolt is then entirely free to move without any effect on the bolt, which has thus pushed the second pusher 12 back to its stable rest position PSR.

The second intermediate stable rest position PSI is occupied by the second pusher 12 when each pin 6, 7 or eye respectively is engaged in the corresponding eye or pin respectively at the same time.

Preferably, each bolt tends to immobilise the corresponding pin or eye respectively in traction. Each pusher therefore drives hook-shaped bolts.

Figure 6:
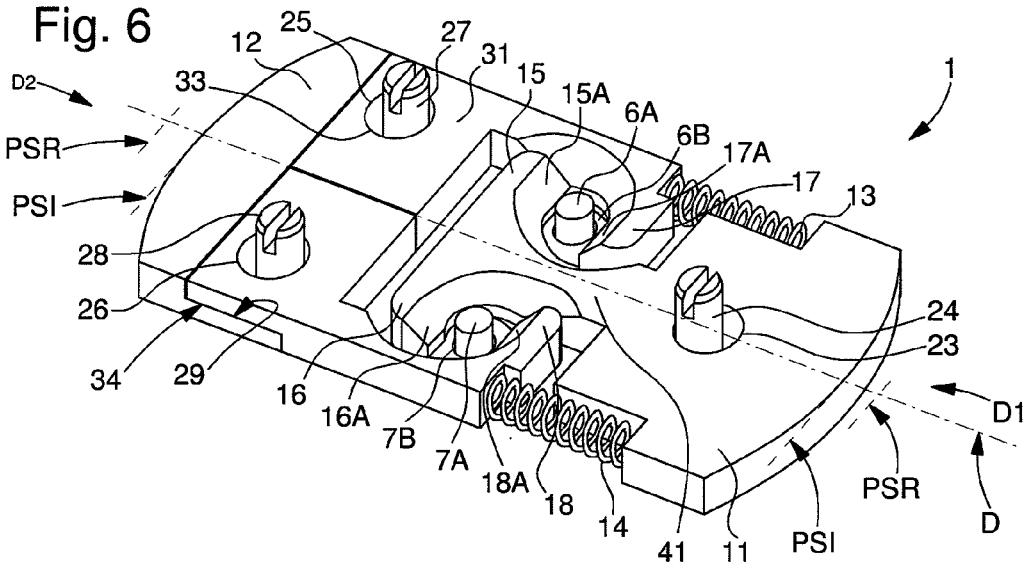
FIG. 6 shows a schematic, partial, perspective, top view of the same clasp in the position of FIG. 2, equipped with return springs which tend to move the two pushers away from each other.

As seen in FIG. 6, the first primary bolt 15 and the second primary bolt 16 each include a bearing surface 15A, 16A which is turned towards the opposite direction to direction D1 of change from the first stable rest position PSR to the third transitory release position PIL, i.e. turned towards the first stable rest position PSR of the first pusher 11. Likewise, the first secondary bolt 17 and the second secondary bolt 18 each include a bearing surface 17A, 18A which is turned towards the direction opposite direction D2 of change from the first stable rest position PSR to the third transitory release position PIL, i.e. turned towards the first stable rest position PSR of the second pusher 12. This arrangement is set up so that, in the absence of any pressure by the user on at least the first pusher 11 or second pusher 12 respectively, the first primary bolt 15 and the second primary bolt 16, or the first secondary bolt 17 and said second secondary bolt 18 respectively, tend to move closer to the first secondary bolt 17 and the second secondary bolt 18, or the first primary bolt 15 and the second primary bolt 16 respectively, in a movement of translation in the opposite direction to the first actuating direction D, or second actuating direction D2 respectively, under the action of resilient return means which are preferably the same as the resilient return means 13, 14 against which the first pusher 11 and second pusher 12 can move.

The bearing surfaces 15A, 16A, 17A, 18A may, as seen in FIGS. 6, 7, 9 and 10, be sloped and/or rounded. They are advantageously formed by beaks connected to the corresponding bolts by tapered surfaces arranged to tend to push back the heads 6B, 7B of pins 6 and 7.

This hook configuration ensuring traction locking ensures that the locking pins are held properly and also that the components of clasp 1 are kept inside said clasp.

FIG. 9 shows a device, in the form of an operating clearance J, for preventing clasp 1 from opening.

Figure 7:
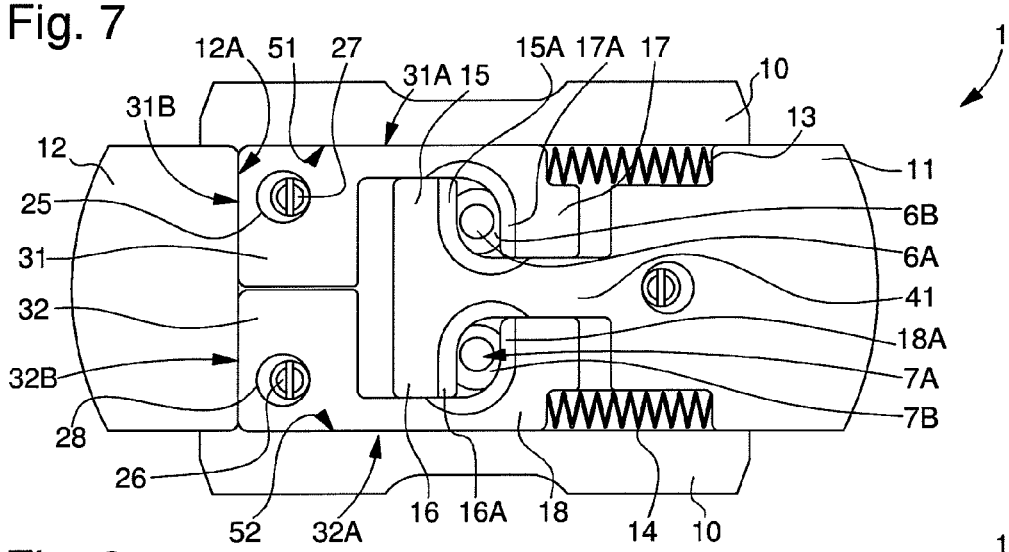
FIG. 7 shows a schematic, partial, top view of a variant of the clasp of FIG. 2 wherein the operating bolts controlled by the pushers include particular bearing surfaces.
Figure 8:
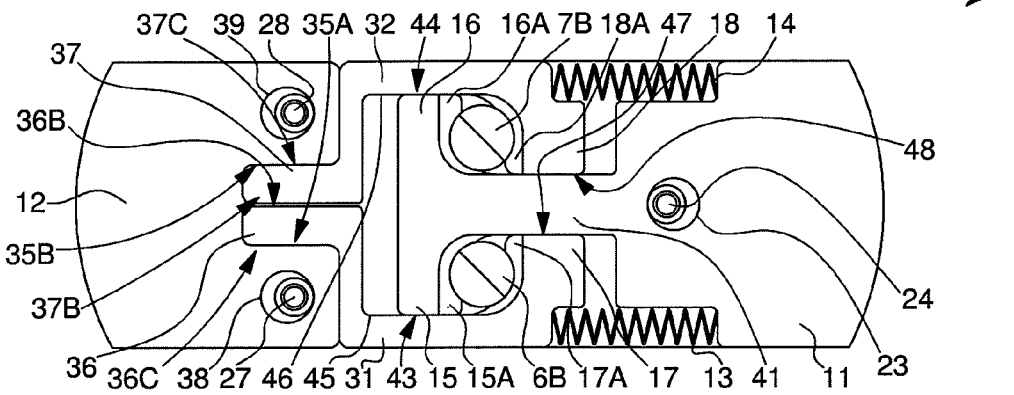
FIG. 8 shows the bottom view of FIG. 7.

FIGS. 7 and 8 illustrate a particular embodiment of the invention, in which the first pusher 11 adopts the configuration of a male pusher, including, in the median part thereof, a connecting arm 41 with an end portion carrying the first primary bolt 15 and the second primary bolt 16. The second pusher 12 is devised to operate, by thrust, a first female slide 31 carrying the first secondary bolt 17, and a second female slide 32 carrying the second secondary bolt 18.

In order to ensure both that the components are held securely and the travels are limited, the invention comprises a certain number of stop members. Thus the mobility of the first pusher 11 relative to buckle 10 is limited by the travel of a stop 24 in a chamber 23. Likewise, the mobility of the first secondary bolt 17 and the second secondary bolt 18 relative to buckle 10, or more precisely the slides 31 and 32 which carry said bolts, is limited by the travel of a stop 27, 28 in a chamber 25, 26, as seen in FIGS. 2, 7 and 8.

Likewise, the mobility of the actual second pusher 12 relative to buckle 10 is limited by the travel of at least one stop 27, 28 in a chamber 38, 39.

In a particular embodiment, seen in FIG. 6, the second pusher 12 includes a sliding bearing surface 29 arranged to cooperate with a complementary sliding surface 33, 34 either comprised in each of secondary bolts 17, 18 or in each of female slides 31, 32 which carry said bolts.

In the version illustrated in the Figures, these slides 31, 32 are called "female" since they are arranged to form guide means for the male pusher 11. Thus, buckle 10 comprises bearing surfaces 51, 52 which guide in translation in direction D, and which are arranged to cooperate with first complementary guide surfaces 31A, 32A comprised in secondary bolts 17, 18 or slides 31, 32 carrying said secondary bolts 17, 18. These secondary bolts 17, 18 or slides 31, 32 further include second guide surfaces 36B, 37B arranged to cooperate with each other, or with a guide element in direction D comprised in buckle 10 and/or second pusher 12 and/or first pusher 11.

FIG. 8 illustrates a version wherein these second guide surfaces 36B, 37B belong to studs 36, 37 comprised in secondary bolts 17, 18 or slides 31, 32 carrying said secondary bolts 17, 18. These studs comprise other guide surfaces 36C, 37C arranged to cooperate with the sides 35A, 35B of a groove comprised in second pusher 12.

In a particular embodiment illustrated in FIG. 8, the first secondary bolt 17 and the second secondary bolt 18, or the female slides 31, 32 carrying the same, comprise guide surfaces 45, 46 extending in direction D and arranged to cooperate with complementary guide surfaces 43, 44 comprised in the first pusher 11 in proximity to the first primary bolt 15 and the second primary bolt 16.

In a particular embodiment illustrated in FIG. 8, the first secondary bolt 17 and the second secondary bolt 18, or the female slides 31, 32 which carry the same, comprise guide surfaces 47, 48 which extend in direction D and are arranged to cooperate with an arm 41 comprised in the median part of first pusher 11.

The particular design of the pusher guide surfaces and the bolts of the clasp according to the invention guarantee flexible and precise operation without any butting.

The clasp according to the invention is also particularly robust and is well suited to fastening the bracelet of an expensive watch or piece of jewellery.

The invention also concerns a bracelet 100 including a clasp 1 of this type.

What is claimed is:

1. A triple security unfolding clasp for holding two ends of a bracelet or strap, said clasp comprising a buckle around both sides of which are hinged a first strand and a second strand, each carrying respectively a first and second shouldered locking pin, and arranged to cooperate in a closing position of said clasp with a complementary locking eye comprised in said buckle, and wherein said buckle includes two pushers, including a first pusher and a second pusher, which can move in a same direction, each against resilient return means returning said two pushers towards a locking position and each of said two pushers arranged to control, directly or indirectly, the forward or backward movement of a first primary bolt and a secondary primary bolt, which are facing each other in said direction with a first secondary opposite bolt and a second secondary opposite bolt controlled by one of said two pushers, each said bolt being arranged to immobilize, in said closing position, at said complementary locking eye, a constricted portion comprised in said locking pin, and an individual travel of each of said pushers is smaller than a release travel during which at least two bolts facing each other release, in an opening position, said constricted portion of at least one of said locking pins, and a cumulated travel of said pushers is greater than or equal to said release travel, wherein said first pusher simultaneously, directly and integrally drives said first primary bolt opposite a first locking pin, and said second primary bolt opposite a second locking pin, whereas said second pusher independently drives a first secondary bolt opposite said first locking pin, and a second secondary bolt opposite said second locking pin, so that only a combined actuation of said two pushers causes the movement of all of the bolts through their entire release travel to release both said first locking pin and said second locking pin, and so that one of said two secondary bolts remains in a locking return position during the insertion of one of said locking pins towards said complementary locking eye corresponding thereto, to a locking position.

2. The triple security unfolding clasp according to claim 1, wherein, when the user exerts pressure, said second pusher is arranged to push, in said direction and via a bearing surface comprised in said second pusher, a first bearing surface of said first secondary bolt, or a first female slide carrying said first secondary bolt and a second bearing surface of said second secondary bolt, or a second female slide carrying said second secondary bolt, so as to move said first secondary bolt and said second secondary bolt parallel to each other.

3. The triple security unfolding clasp according to claim 1, wherein, in the absence of any action by the user on one of the pushers, said first secondary bolt and said second secondary bolt, or a first female slide carrying said first secondary bolt and a second female slide carrying said second secondary bolt can move independently of each other against said resilient return means.

4. The triple security unfolding clasp according to claim 1, wherein, in the absence of any action by the user on one of the pushers, said first secondary bolt and said second secondary bolt can move independently of each other against said resilient return means.

5. The triple security unfolding clasp according to claim 1, wherein a first said complementary locking eye, is delimited by the cooperation of said first primary bolt and said first secondary bolt, and wherein a second said complementary locking eye is delimited by the cooperation of said second primary bolt and said second secondary bolt, and each said complementary locking eye constitutes a chamber of variable volume, between an opening position in which said complementary locking eye is able to let pass a head comprised in said locking pin corresponding thereto, and a closing position in which said complementary locking eye is able to grip said constricted portion of one said locking pin corresponding thereto, between jaws formed by bearing surfaces comprised in said bolts, and immobilizing said head on the opposite side to said strand carrying said locking pin, relative to said jaws.

6. The triple security unfolding clasp according to claim 1, wherein said first pusher, like said second pusher, is moveable in said direction between a first stable rest position of maximum extension relative to said buckle and in which said pusher does not cooperate with any of said locking pins, another second stable intermediate locking position in which said pusher immobilizes at least one of said locking pins, and a third transitory release position under maintained pressure by the user and in which said pusher tends to release said locking pins, said first pusher being moveable from said first stable rest position to said third transitory release position in a first actuating direction, and said second pusher being moveable from said first stable rest position to said third transitory release position in a second actuating direction opposite to said first direction, and wherein said first primary bolt and said second primary bolt each include a bearing surface which is turned towards said first stable rest position of said first pusher, and wherein said first secondary bolt and said second secondary bolt each include a bearing surface which is turned towards said first stable rest position of said second pusher, so that, in the absence of any pressure by the user on at least said first pusher or respectively on said second pusher, said first primary bolt and said second primary bolt, or said first secondary bolt and said second secondary bolt respectively, tend to move closer to said first secondary bolt and said second secondary bolt, or to said first primary bolt and said second primary bolt respectively, in a movement of translation in the opposite direction to said first actuating direction or to said second actuating direction respectively, under the action of said resilient return means.

7. The triple security unfolding clasp according to claim 6, wherein said first stable rest position and said second stable intermediate locking position of said first pusher are the same, and wherein said first stable rest position and said second stable intermediate locking position of said second pusher are the same.

8. The triple security unfolding clasp according to claim 1, wherein the mobility of said first pusher relative to said buckle is limited by the travel of a stop in a chamber, and wherein the mobility of said first secondary bolt and said second secondary bolt relative to said buckle is limited by the travel of a stop in a chamber.

9. The triple security unfolding clasp according to claim 1, wherein the mobility of said second pusher relative to said buckle is limited by the travel of at least one stop in a chamber.

10. The triple security unfolding clasp according to claim 1, wherein said second pusher includes a sliding bearing surface arranged to cooperate with a complementary sliding surface comprised in each of said secondary bolts.

11. The triple security unfolding clasp according to claim 1, wherein said buckle includes bearing surfaces for guiding in translation in said direction, arranged to cooperate with first complementary guide surfaces comprised in said secondary bolts or comprised in slides carrying said secondary bolts, which also include second guide surfaces arranged to cooperate with each other or with a guide element in said direction comprised in said buckle or said second pusher or said first pusher.

12. The triple security unfolding clasp according to claim 1, wherein said first secondary bolt and said second secondary bolt include guide surfaces extending in said direction and arranged to cooperate with complementary guide surfaces comprised in said first pusher in proximity to said first primary bolt and second primary bolt.

13. The triple security unfolding clasp according to claim 1, wherein said first secondary bolt and said second secondary bolt include guide surfaces extending in said direction and arranged to cooperate with an arm comprised in the median part of said first pusher.

14. A bracelet including a clasp according to claim 1.

* * * * *